US006527916B2

(12) United States Patent
Schiel

(10) Patent No.: US 6,527,916 B2
(45) Date of Patent: Mar. 4, 2003

(54) PRESSING SECTION FOR A PAPER MACHINE

(75) Inventor: Christian Schiel, Murnau (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/828,356

(22) Filed: Apr. 9, 2001

(65) Prior Publication Data

US 2002/0060050 A1 May 23, 2002

(30) Foreign Application Priority Data

May 8, 2000 (DE) ..... 100 22 087

(51) Int. Cl.[7] ..... D21F 3/04
(52) U.S. Cl. ..... 162/360.2; 162/358.2
(58) Field of Search ..... 162/358.2, 358.3, 162/360.2

(56) References Cited

U.S. PATENT DOCUMENTS

| | | | | | |
|---|---|---|---|---|---|
| 4,500,588 | A | * | 2/1985 | Lundstrom | 162/900 |
| 4,529,643 | A | * | 7/1985 | Lundstrom | 162/900 |
| 4,976,821 | A | | 12/1990 | Laapotti | 162/360.1 |
| 5,298,124 | A | * | 3/1994 | Eklund et al. | 162/358.2 |
| 5,389,205 | A | * | 2/1995 | Pajula et al. | 162/360.2 |
| 5,393,384 | A | | 2/1995 | Steiner et al. | 162/359.1 |
| 5,772,849 | A | * | 6/1998 | Meschenmoser | 162/360.2 |

FOREIGN PATENT DOCUMENTS

| | | | |
|---|---|---|---|
| DE | 1180237 | * 10/1964 | 162/360.2 |
| DE | 3515576 | 11/1985 | |
| DE | 4224730 | 9/1993 | |
| DE | 29810486 | 1/1998 | |

OTHER PUBLICATIONS

W. Schuwerk, "Pole Position in der Erzeugung von Karton und Verpackungspapieren", Wochenblatt für Papierfabrikation, No. 6, 1999; pp.380–385.

H. Ilvespää, "Herausforderung an das Geschwindigkeitspotential", Wochenblatt für Papierfabrikation, No. 2, 1999; pp.94–99.

"Process and Progress", Wochenblatt für Papierfabrikation, No. 11/12, 1999; pp.745–752.

Dr. M. Schlegel; "Prozess & Progress mit NipcoFlex, QualFlex, EcoFlex", Wochenblatt für Papierfabrikation, No. 21, 1999; pp.1380–1386.

Wochenblat für Papierfabrikation, No. 20, 1999; before p. 1296.

* cited by examiner

*Primary Examiner*—Karen M. Hastings
(74) *Attorney, Agent, or Firm*—Greenblum & Bernstein, P.L.C.

(57) ABSTRACT

Pressing section of paper machine including first and a second pressing stations, a common lower felt arranged to run through first and the second pressing stations, and an first upper felt and a second upper felt arranged to run through first and second pressing stations. Second pressing station includes shoe press roll located above a lower roll, and pressing plane of second pressing station is oriented essentially vertically or inclined at an angle β, which is a maximum of about 20° to vertical. The common lower felt is sufficiently dense to be essentially air impermeable even in its new state after moistening, and is sufficiently open to allow water through at pressures greater than about 5 bar. First and second upper felts are sufficiently open to allow air through in their moistened, uncompressed state, and pressing plane of first pressing station is oriented at an angle greater than angle β.

21 Claims, 2 Drawing Sheets

PRESSING SECTION FOR A PAPER MACHINE

CROSS-REFERENCE TO RELATED APPLICATIONS

The present application claims priority under 35 U.S.C. §119 of German Patent Application No. 100 22 087.8, filed on May 8, 2000, the disclosure of which is expressly incorporated by reference herein in its entirety.

BACKGROUND OF THE INVENTION

1. Field of the Invention

The invention concerns a pressing section for pressing water out of a paper web. Pressing sections have become known in numerous configurations. The invention relates to such pressing sections in which at least two pressing stations are present, of which at least the second pressing station is formed of a so-called shoe press and in which the paper web is pressed between two felts.

2. Discussion of Background Information

Such pressing sections have already been used for a long time in the production of thicker packaging papers. Such papers are produced at medium speeds. Here, the above-mentioned pressing sections have proven themselves. See Wochenblatt für Papierfabrikation [Paper Manufacturing Weekly], No. 6, 1999; p. 380–385, in particular FIG. 19. It is possible to use relatively coarse felts for these packaging papers that do mark the paper web, but have a high air permeability.

More recently, the attempt has been made to use pressing sections of the above-mentioned type in a slightly modified construction for the production of thinner papers, which are produced at higher speeds, for example, printing papers. They are described in "Wochenblatt für Papierfabrikation" ["Paper Manufacturing Weekly"], No. 2, 1999; p. 94 to 99, FIGS. 7, 11, and 16 as well as in Wochenblatt für Papierfabrikation [Paper Manufacturing Weekly], No. 11/12, 1999; p. 745 to 752, figure of the PM 5 Compact Lang Papier, Ettringen on page 746. It has been shown that pressing sections of the type mentioned above are advantageous because both sides of the paper web have printing properties that are approximately identical in quality. However, the results have not been completely satisfactory up to now. Specifically, the problems are as follows:

Insufficient dry contents were achieved with pressing sections of the type mentioned above. Thus, the paper web is still relatively moist after leaving the pressing section. Furthermore, the dry content of the paper web is not even across the web width.

The separation of the paper web from one or the other felt after passing through the individual pressing stations is critical; occasionally, tearing of the edges of the paper web occurs. Besides the higher speeds, these problems are also connected to the fact that the felts for thin papers must be denser and smoother due to the quality requirements of the paper surfaces to be printed. Thus, their dewatering becomes more difficult. The function of the suction felt guide rolls becomes less certain. They are supposed to hold the paper web safely on the felt provided for further transport during the separation of the two felts. However, this latter is only successful when the transport felt is sufficiently open and air permeable.

SUMMARY OF THE INVENTION

The present invention provides a pressing section that includes a first and a second pressing station, a common lower felt arranged to run through the first and the second pressing stations, and an first upper felt and a second upper felt arranged to run through the first and second pressing stations. The second pressing station includes a shoe press roll located above a lower roll, and a pressing plane of the second pressing station is oriented one of essentially vertically or inclined at an angle $\beta$, which is a maximum of about 20° to a vertical reference. Moreover, according to the instant invention, the pressing section is more efficient to use for thinner papers at higher machine speeds as well, in particular for printing papers. Thus, such a pressing section should have its own advantages with respect to the even printability properties on both sides of the web. Moreover, it should be free from the above-mentioned disadvantages and should by all means allow a longer felt service life. It should also prevent the problem of tears in the edges of the paper web and reduce the number of suction felt rolls, their energy use, and their noise level.

Accordingly, the present invention also includes a common lower felt that is sufficiently dense to be essentially air impermeable even in its new state after moistening, and that is sufficiently open to allow water through at pressures greater than about 5 bar. The first and second upper felts are sufficiently open to allow air through in their moistened, uncompressed state, and a pressing plane of the first pressing station being oriented at an angle $\alpha$, which is greater than angle $\beta$, and preferably where angle $\alpha$ is greater than about 20° to the vertical reference.

Specifically, the inventor recognized the following:

For the purpose of better printability, the felts must have as smooth a surface as possible. Further, the water tightness of the felts is an extremely critical parameter. It must be set in such a way that a rewetting of the paper by the belts cannot occur after each pressing station. The lower felt must be made sufficiently watertight that it is not only air impermeable, but also, in the case of small differences in pressure and by capillarity, returns as good as no water to the paper web during a contact period of approximately 0.1 to 0.2 seconds after each of the two pressing sections.

Moreover, the upper felts must be open and air permeable so that the paper web remains securely adhered to the lower felt (to which it adheres due to its lack of air permeability) when the felts are being separated after the pressing stations and, as a result of the air flowing in from above, separates itself from the upper felt. Here, the contact time between the paper web and the upper felt after each pressing station should be minimized so that the reverse moistening of the paper web by the upper felt remains low.

The combination of features according to the invention provides an elegant selection from a plurality of features that leads to success. Specifically, the following advantages can be attained:

The web leaves the pressing section with a greater dry content than before, which leads to fewer tears in the paper web. This increases the production capacity. Further, there are no strips of different degrees of dryness (moist strips) in the web cross profile, and the felts need to be dewatered to a lesser degree. The necessary energy for providing the vacuum as well as the number of suction rolls can be reduced while increasing the service life of the felts, since the latter can be more specialized for one single purpose. Moreover, the number of felts itself is reduced such that the machine is also more accessible, especially in the cellar of the machine, and the noise level of the machine and the energy consumption of the press section during operation are reduced.

The following is specifically achieved in accordance with features of the instant invention:

The common lower felt being sufficiently dense to be essentially air impermeable even in its new state after moistening, and the first and second upper felts being sufficiently open to allow air through in their moistened, uncompressed state allow an essentially flawless separation of the web from the upper felt upon exiting the pressing station; the web reliably follows the lower felt, which is desired. The common lower felt being sufficiently open to allow water through at pressures greater than about 5 bar ensures the evenness of dewatering of the paper web towards both of its surfaces, which is essential for printability. A pressing plane of the first pressing station which is oriented at an angle $\alpha$, which is greater than angle $\beta$, and preferably which is greater than about 20° to a vertical reference contributes to the prevention of reverse moistening of the paper web by the upper felt upon exiting the pressing station.

In further embodiments, the jacket of the first upper pressing roll is grooved or blind bored. Thus, a storage capacity is created so that not as much emphasis is placed on the storage capacity of the upper felt of the first press. This upper felt is thus relieved in a certain manner. The result is that it can be optimized with respect to other requirements. It can now be constructed in such a way that it leaves behind less pronounced markings on the paper. Furthermore, it can be constructed to be lighter and more supple. This allows a faster and less expensive installation when changing felts.

If something is true for the upper felt, it is true in a similar manner for the lower felt, which is common to both presses, as well as for the upper felt of the second press. Each felt may be specialized for a particular task.

An interesting further embodiment of the invention includes of constructing the lower felt out of at least two layers. Here, the outer layer, which is in contact with the paper, has relatively little or hardly any air permeability and thus is relatively dense, smooth, and not very compressible. The inner layer, on the other hand, is very permeable and has a high water storage capacity. This variant especially comes into consideration when no use is made of the blind boring and/or grooving of the upper press roll.

With the above-mentioned two-layer structure, it is possible to discharge the water stored in the permeable inner layer with little expense and to remove it laterally from the felt loop.

The present invention is directed to a pressing section of a paper machine. The pressing section includes a first and a second pressing station, a common lower felt arranged to run through the first and the second pressing stations, and an first upper felt and a second upper felt arranged to run through the first and second pressing stations. The second pressing station includes a shoe press roll located above a lower roll, and a pressing plane of the second pressing station is oriented one of essentially vertically or inclined at an angle $\beta$, which is a maximum of about 20° to a vertical reference. The common lower felt is sufficiently dense to be essentially air impermeable even in its new state after moistening, and is sufficiently open to allow water through at pressures greater than about 5 bar. The first and second upper felts are sufficiently open to allow air through in their moistened, uncompressed state, and a pressing plane of the first pressing station being oriented at an angle $\alpha$, which is greater than angle $\beta$.

In accordance with a feature of the instant invention, angle $\alpha$ can be greater than about 20° to the vertical reference.

Further, the first pressing station may include an upper pressing roll having a jacket surface which is one of grooved or blind bored. The shoe press roll of the second pressing station may include a jacket surface which is one of grooved or blind bored.

The common lower felt may have at least two layers including an outer layer, arranged to contact a paper web, which is air impermeable in a moistened state and an inner layer which is permeable and capable of storing water. Water removal from the common lower felt may occur substantially exclusively inwardly. At least one dewatering station can be assigned to at least one of the common lower felt and the first and second upper felts. The at least one dewatering station can include a water receiving tank arranged behind a felt deflection roll. The water receiving tank may be formed generally around an outside of the felt deflection roll. The at least one dewatering station can be formed as a flushing device that includes a device for conducting flushing air to an inner side of the least one felt as well as suction slits for removing water stored in the at least one felt.

According to another feature of the invention, a suction roll arranged in a loop of the first upper felt of the first pressing station.

The first pressing station can include a shoe press roll arranged as a lower roll. Subsequent to a concave pressing surface, a press shoe of the lower roll of the first pressing station can have a convexly bent sector with a radius of about 40 to 80 mm and an extension of about 2.5 to 5°, upon which a sector with a greater radius follows.

An edge depressor may be arranged after at least one of the first and the second pressing stations. The first and the second upper felt have felt edges, and at least one of the felt edges of at least one of the first and the second upper felts can be deflected downwardly by the edge depressor after running through a respective pressing station. The deflection can occur over an edge region with a width of over about 100 mm, and the deflection may increase outwardly toward the felt edge. Further, the deflection may increase towards the felt edge from about 20 mm inside the felt edge.

The present invention is directed to a pressing section of a paper machine. The pressing section includes a first and a second press, in which the first and second presses are double felted presses. A lower felt is arranged to run through the first and the second presses, and the common lower felt is sufficiently dense to be essentially air impermeable even in its new state after moistening, and is sufficiently open to allow water through at pressures greater than about 5 bar. First and second upper felts, which are arranged to run through the first and the second presses, respectively, are sufficiently open to allow air through in their moistened, uncompressed state. A pressing plane of the first press is oriented obliquely with respect to a pressing plane of the second press.

According to another feature of the invention, an edge depressor can be arranged after at least one of the first and the second presses to deflect an edge of the at least one of the first and the second upper felts toward the common lower felt.

In accordance with yet another feature of the present invention, the first and second presses can include shoe presses, and a lower roll of the first press and an upper roll of the second press may include a shoe press roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
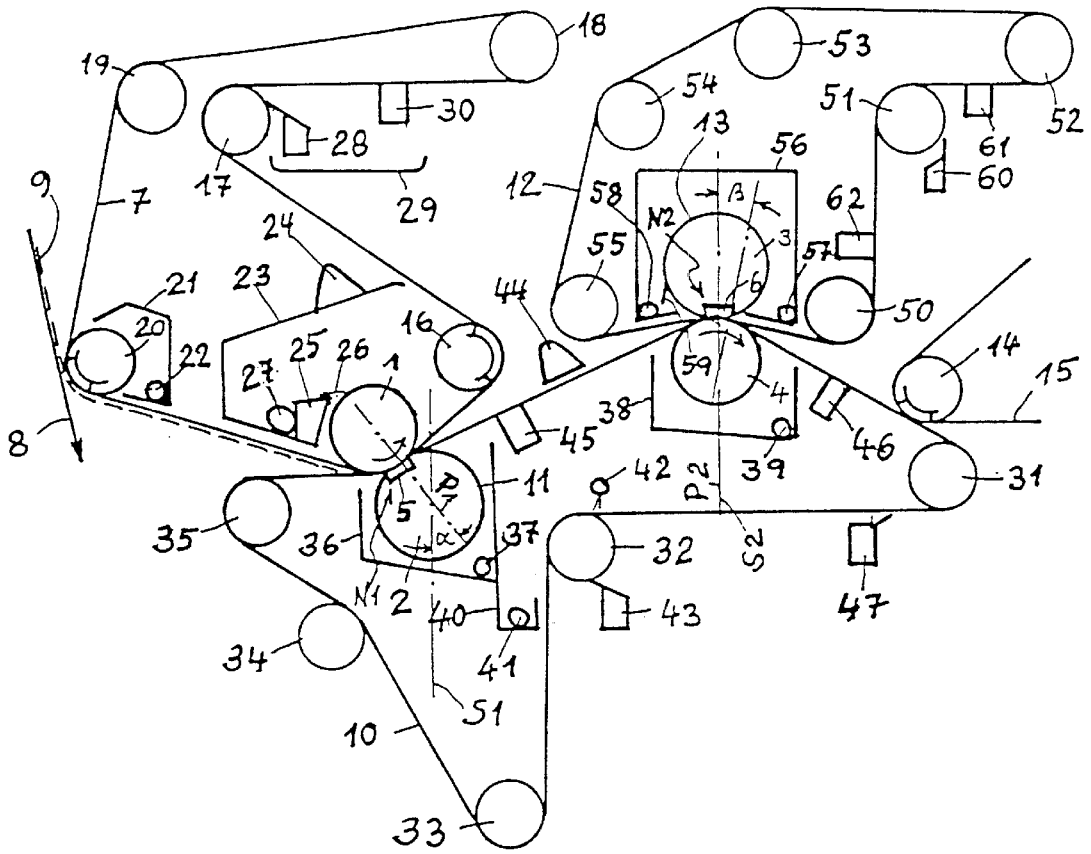
FIG. 1 illustrates a pressing section in a schematic side view, in which details of the structure of the machine and frame have been omitted in order to improve the clear depiction.

The press section shown in FIG. 1 has two presses with the rolls 1 and 2 as well as the rolls 3 and 4. Rolls 1 and 2 form a pressing station N1 with one another and rolls 3 and 4 form a pressing station N2. Both rolls 2 and 3 are shoe press rolls.

A first upper felt 7, paper web 9 arriving from forming wire 8, lower felt 10, and pressing jacket 11 of lower pressing roll 2 are running through first pressing station N1 in the direction of the arrow. Lower felt 10, with paper web 9, continues to, and through, second pressing station N2 along with second upper felt 12 and pressing jacket 13. Paper web 9 follows lower felt 10 up to removal roll 14, where it is transferred by this roll onto first drying wire 15, which conducts paper web 9 into a drying section (not shown).

After the pressing station N1, first upper felt 7 runs over a suction felt guide roll 16, a guide roll 17 lying to the outside, a tension roll 18, and a regulating roll 19 back to removal roll 20, which removes paper web 9 from forming wire 8.

Removal roll 20 is surrounded by a water receiving unit 21 with a lateral outlet 22. Rolls 1 and 16 throw the water arriving from paper web 9 and felt 7 into a receiving unit 23 with a lateral outlet 27.

Receiving unit 23 is reinforced by two crosswise supports 24 and 25. A water stripper 26 that strips free water off of the surface of roll 1 is fastened to crosswise support 25. Water stripper 26 can also be adjusted to a slight distance from the surface of roll 1 so that it is no longer in contact with the roll.

The jacket surface of roll 17 is cleaned by doctors 28. The resulting soiled material falls into tank 29. For the purpose of further cleaning and dewatering, the outer surface of felt 7 can be guided over a suction tube 30. The spraying tubes commonly used for moistening and further cleaning of the felt are not shown.

After pressing station N2, lower felt 10 runs over guide rolls 31 and 32 to tension roll 33 and over regulating roll 34 and guide roll 35 back into first pressing station N1.

Lower pressing roll 2 is surrounded by a receiving tank 36 with a lateral outlet 37 and pressing roll 4 is surrounded by a receiving tank 38 with a lateral outlet 39. A water receiving unit 40 with a lateral outlet 41 is provided following outer guide roll 32. Above guide roll 32 is a blowing tube 42 with which streams of air distributed over the width of felt 10 are blown onto the inner side of felt 10, which promotes throwing off water into unit 40. The jacket surface of roll 32 is cleaned by a doctor 43.

Paper web 9 can be warmed between pressing stations N1 and N2 by a steam blow box 44. For the purpose of further dewatering, lower felt 10, flushers 45, 46, formed in accordance with DGM 289 10 486.5, the disclosure of which is expressly incorporated by reference herein in its entirety, can be used. Loose soiled material is removed from the outer layer of felt 10 by a stripper 47. As an alternative, a suction tube can also be used. The spraying tubes commonly used for moistening and further cleaning of the felt are not shown.

After pressing station N2, second upper felt 12 runs back again over guide rolls 50, 51, tension roll 52, regulating roll 53, and guide rolls 54, 55. Water thrown off of roll 3 is collected in receiving tank 56 and laterally removed by way of outlets 57 and 58. A stripper 59 can additionally strip water from roll jacket 13. Guide roll 51 is cleaned by doctor 60. Outer surface of the felt 12 can be cleaned by suction pipe 61. A flusher 62 can serve to additionally dewater felt 12.

Pressing plane P1 of first pressing station N1 is inclined by an angle $\alpha$ of at least about 20° to a vertical reference S1. Pressing plane P2 can essentially correspond to the vertical reference S2 (as shown in FIG. 1) or can be inclined in the travel direction by a small angle $\beta$ up to approximately 20°. In this case, the midpoint of roll 3 wanders to the right by angle $\beta$.

These preferred inclinations of the pressing planes serve the optimal felt guide by which, on the one hand, the construction costs are minimized and, on the other hand, the felt separation can be performed in such a way that the paper web is securely conducted out of the pressing sections with minimal reverse moistening by the upper felt. Because of its very dense outer layer, no appreciable reverse moistening of the paper occurs by lower felt 10.

Figure 2:
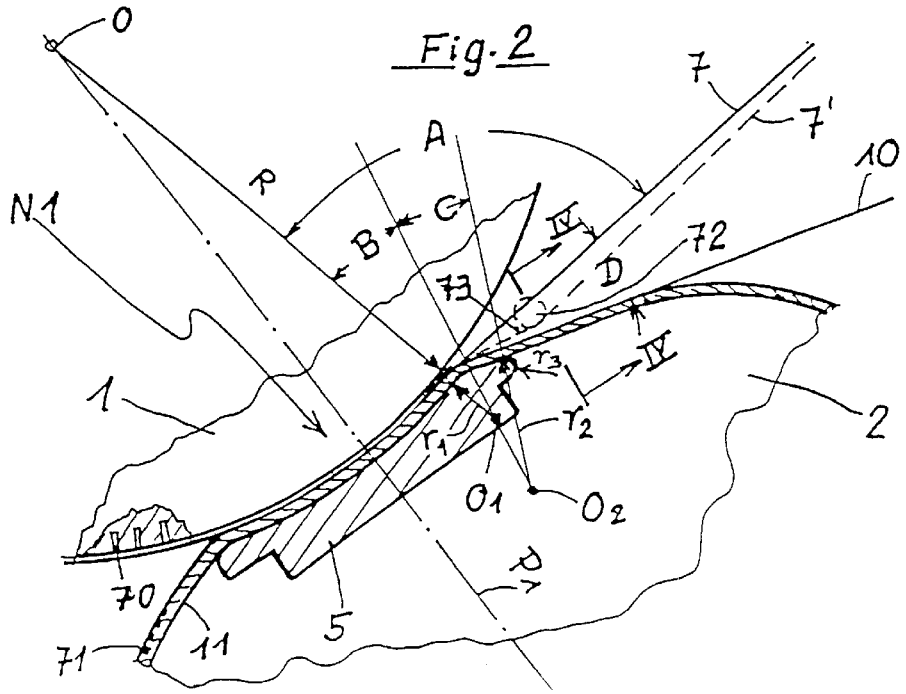
FIG. 2 illustrates the discharge region of the first press with a lower shoe press roll in a longitudinal view.

FIG. 2 is an enlarged section of the region of the pressing station N1. Pressing rolls 1 and 2, felts 7 and 10, and pressing jacket 11, which is being pressed by press shoe 5 in the direction of roll 1, are discernible. Blind bores 70 can be seen in the surface of roll 1 and blind bores 71 can be seen in the surface of pressing jacket 11.

Subsequent to the concave region of the press shoe, which has a curving radius that is somewhat larger than the radius R of the upper roll with the axis O, there follows first a convex cylindrically curved region with a curving radius r1 with the midpoint O1. The size of r1 lies in the range of about 40 to 80 mm. This cylindrically curved region extends over an angle B of about 2.5 to 5°, next to which another convex cylindrically curved region with a greater radius r2 is located, spanning an angle region C. A rounding r3 is located at the end of this region.

The angle A between the connecting straight lines between the midpoints O and O1 and the exiting felt 7 is greater than about 90°, preferably about 92 to 96°, the opening angle D between the two exiting felts 7 and 10 should be greater than about 8°, preferably between about 10 and 20°, so that the wedge-shaped opening 73 between felts 7 and 10 can be easily reached by the air flowing in against the travel direction and so that the buildup of too high of a vacuum, which could lead to a fluttering of the felts, is prevented.

Dashed circle 72 is the contour of an edge depressor for felt 7, which can be used as needed. Felt 7 is deflected into path 7' by an edge depressor 72 so that no air can flow from the side into wedge-shaped opening 73 immediately behind the separation point of felts 7 and 10.

Figure 3:
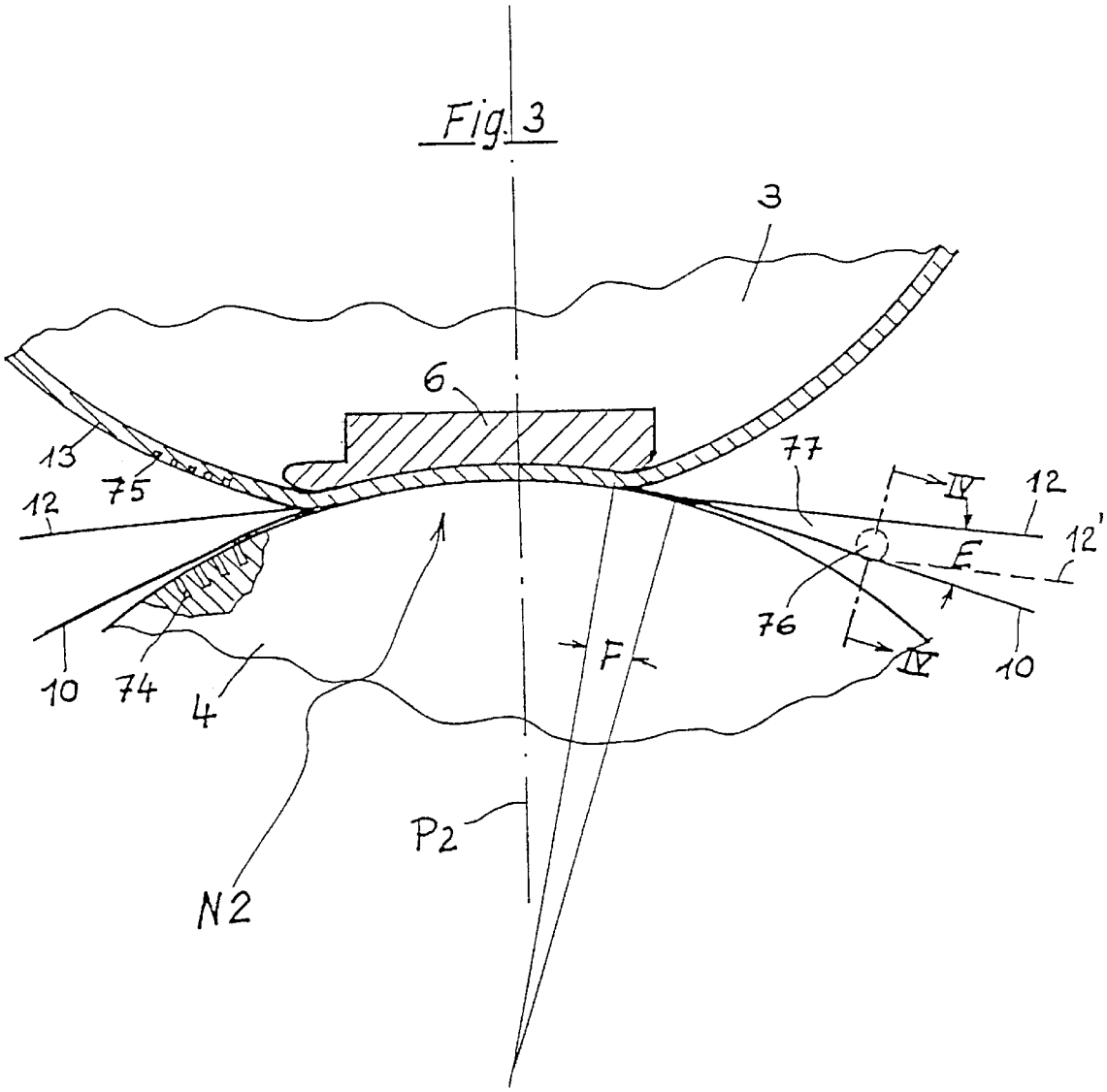
FIG. 3 illustrates the discharge region of the second press in a longitudinal view.

FIG. 3 is an enlarged section of pressing station N2 that is formed between upper roll 3 and lower roll 4. Felts 10 and 12 run through pressing station N2 along with pressing jacket 11 and paper web 9, which cannot be shown because of its too-small thickness, lying flat on felt 10. Press shoe 6 may be pushed downwards against roll 4. Blind bores 74 and 75, only some of which are shown by way of example, are worked into the surfaces of roll 4 and of pressing jacket 13 respectively.

An edge depressor 76 presses the edge of upper felt 12 behind its separation from lower felt 10 against this lower felt so that no air can flow from the side into the wedge-shaped opening 77 immediately after the felt separation. The opening angle E between the exiting felts 10 and 12 is greater than about 8°, preferably between about 10 and 20°. The wrapping angle F between the end of the pressing zone and the tangential exit direction of felt 12 is between about 2 and 8°.

Figure 4:
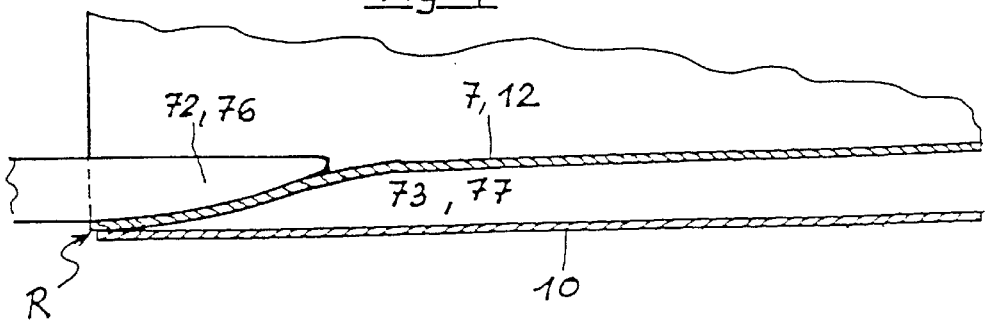
FIG. 4 illustrates a partial cross section of the discharge regions of depicted in FIGS. 2 and 3 along section lines IV—IV.

FIG. 4 is a partial section of an edge region after the separation of upper felt 7 and 12 from upper felt 10 along the section lines IV—IV in FIGS. 2 and 3. Edge depressors 72 and 76 press upper felts 7 and 12 on the edge down to lower felt 10 so that no air can flow from the edges R of the felts into the wedge-shaped openings 73 and 77.

In closing, it should also be emphasized that, by preventing reverse moistening according to the arrangement of the invention, not only is the dry content improved, but also the paper quality, in such a way that the specific volume is increased that is needed to achieve greater smoothness and good printability. An evenly high or evenly higher dry content results with lower pressing forces. Because of this, the service life of the felts is increased as well.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A pressing section of a paper machine comprising:

a first and a second pressing station;

a common lower felt arranged to run through said first and said second pressing stations;

an first upper felt and a second upper felt arranged to run through said first and second pressing stations;

said second pressing station comprising a shoe press roll located above a lower roll;

a pressing plane of said second pressing station being oriented one of essentially vertically or inclined at an angle β, which is a maximum of about 20° to a vertical reference;

said common lower felt being sufficiently dense to be air impermeable even in its new state after moistening, and being sufficiently open to allow water through at pressures greater than about 5 bar;

said first and second upper felts being sufficiently open to allow air through in their moistened, uncompressed state; and a pressing plane of said first pressing station being oriented at an angle α, which is greater than angle β.

2. The pressing section in accordance with claim 1, wherein angle α is greater than about 20° to the vertical reference.

3. The pressing section in accordance with claim 1, wherein said first pressing station comprises an upper pressing roll having a jacket surface which is one of grooved or blind bored.

4. The pressing section in accordance with claim 3, wherein said shoe press roll of said second pressing station includes a jacket surface which is one of grooved or blind bored.

5. The pressing section in accordance with claim 1, wherein said common lower felt comprises at least two layers including an outer layer, arranged to contact a paper web, which is air impermeable in a moistened state and an inner layer which is permeable and capable of storing water.

6. The pressing section in accordance with claim 5, wherein water removal from said common lower felt occurs substantially exclusively inwardly.

7. The pressing section in accordance with claim 6, further comprising at least one dewatering station assigned to at least one of said common lower felt and said first and second upper felts.

8. The pressing section in accordance with claim 7, wherein said at least one dewatering station comprises a water receiving tank arranged behind a felt deflection roll.

9. The pressing section in accordance with claim 8, wherein said water receiving tank is formed generally around an outside of said felt deflection roll.

10. The pressing section in accordance with claim 7, wherein said at least one dewatering station is formed as a flushing device that includes a device for conducting flushing air to an inner side of said least one felt as well as suction slits for removing water stored in said at least one felt.

11. The pressing section in accordance with claim 1, further comprising a suction roll arranged in a loop of said first upper felt of said first pressing station.

12. The pressing section in accordance with claim 1, wherein said first pressing station comprises a shoe press roll arranged as a lower roll.

13. The pressing section in accordance with claim 12, wherein, subsequent to a concave pressing surface, a press shoe of said lower roll of said first pressing station has a convexly bent sector with a radius of about 40 to 80 mm and an extension of about 2.5 to 5°, upon which a sector with a greater radius follows.

14. The pressing section in accordance with claim 1, further comprising an edge depressor arranged after at least one of said first and said second pressing stations, wherein said first and said second upper felt have felt edges, and at least one of said felt edges of at least one of said first and said second upper felts is deflected downwardly by said edge depressor after running through a respective pressing station.

15. The pressing section in accordance with claim 14, wherein the deflection occurs over an edge region with a width of over about 100 mm.

16. The pressing section in accordance with claim 15, wherein the deflection increases outwardly toward said felt edge.

17. The pressing section in accordance with claim 14, wherein the deflection increases towards the felt edge from about 20 mm inside said felt edge.

18. A pressing section of a paper machine comprising:

a first and a second press, wherein said first and second presses are double felted presses;

a lower felt arranged to run through said first and said second presses;

said common lower felt being sufficiently dense to be air impermeable even in its new state after moistening, and being sufficiently open to allow water through at pressures greater than about 5 bar;

first and second upper felts arranged to run through said first and said second presses, respectively, being sufficiently open to allow air through in their moistened, uncompressed state; and a pressing plane of said first press being oriented obliquely with respect to a pressing plane of said second press.

19. The pressing section in accordance with claim 18, further comprising an edge depressor arranged after at least one of said first and said second presses to deflect an edge of said at least one of said first and said second upper felts toward said common lower felt.

20. The pressing section in accordance with claim 18, wherein said first and second presses comprise shoe presses.

21. The pressing section in accordance with claim 20, wherein a lower roll of said first press and an upper roll of said second press comprise a shoe press roll.

* * * * *